US007979954B2

(12) United States Patent
Moore et al.

(10) Patent No.: US 7,979,954 B2
(45) Date of Patent: Jul. 19, 2011

(54) PORTABLE CLEANING ASSEMBLY WITH WASTE CONTAINER

(75) Inventors: Glen E. Moore, St Clair Shores, MI (US); Susan J. Williamson, Clarkston, MI (US)

(73) Assignee: Vacbarrel, LLC, Clarkston, MI (US)

( * ) Notice: Subject to any disclaimer, the term of this patent is extended or adjusted under 35 U.S.C. 154(b) by 247 days.

(21) Appl. No.: 12/333,017

(22) Filed: Dec. 11, 2008

(65) Prior Publication Data

US 2009/0113664 A1 May 7, 2009

Related U.S. Application Data

(63) Continuation of application No. 11/738,120, filed on Apr. 20, 2007, now Pat. No. 7,472,456, and a continuation of application No. 10/605,343, filed on Sep. 23, 2003, now Pat. No. 7,210,193, and a continuation-in-part of application No. 10/116,768, filed on Apr. 4, 2002, now Pat. No. 6,732,403, said application No. 10/605,343.

(60) Provisional application No. 60/427,288, filed on Nov. 18, 2002, provisional application No. 60/452,418, filed on Mar. 6, 2003, provisional application No. 60/459,380, filed on Mar. 31, 2003.

(51) Int. Cl.
*A47L 9/10* (2006.01)

(52) U.S. Cl. ..... 15/323; 15/347; 15/352; 15/DIG. 1

(58) Field of Classification Search ..... 15/323, 15/347, 327.6, 352, 413, DIG. 1; *A47L 9/10*
See application file for complete search history.

(56) References Cited

U.S. PATENT DOCUMENTS

| | | | |
|---|---|---|---|
| 971,895 | A | 10/1910 | Joedicke |
| 1,681,624 | A | 8/1928 | Replogle |
| 2,042,387 | A | 5/1936 | Cobb |
| 2,528,872 | A | 11/1950 | Dick |
| 2,531,920 | A | 11/1950 | Raminger |
| 3,089,177 | A | 5/1963 | Andersson-Sason |
| 3,172,743 | A | 3/1965 | Kowalewski |
| 3,328,826 | A | 7/1967 | Amos |
| 3,401,420 | A | 9/1968 | Lofgren |
| 4,699,641 | A | 10/1987 | Barnes |
| 4,739,535 | A | 4/1988 | Schuld et al. |
| 4,811,453 | A | 3/1989 | Lubraniecki |
| 5,054,157 | A | 10/1991 | Werner et al. |
| 5,089,037 | A | 2/1992 | Marsolais |
| 5,113,546 | A | 5/1992 | Parent |
| 5,205,013 | A | 4/1993 | Lopes |
| 5,263,223 | A | 11/1993 | Fiegel |
| 6,058,560 | A | 5/2000 | Gab et al. |
| 6,170,118 | B1 | 1/2001 | McIntyre et al. |
| 6,199,714 | B1 | 3/2001 | Thompson |
| 6,206,980 | B1 | 3/2001 | Robinson |
| RE37,350 | E | 9/2001 | Stephan |
| 6,645,666 | B1 | 11/2003 | Moores, Jr. et al. |
| 6,732,403 | B2 | 5/2004 | Moore et al. |
| 6,880,191 | B2 | 4/2005 | Bristor |
| 7,014,949 | B2 | 3/2006 | Kanai et al. |
| 7,120,965 | B2 | 10/2006 | Hisano et al. |
| 7,210,193 | B2 | 5/2007 | Moore et al. |

*Primary Examiner* — David A Redding
(74) *Attorney, Agent, or Firm* — Howard & Howard Attorneys PLLC

(57) ABSTRACT

The subject invention provides a vacuum unit and a waste container. The vacuum unit applies a vacuum to clean an area to collect debris and the waste container collects waste by a user separate from debris collected by the vacuum unit. The vacuum unit includes a battery for powering a motor of the vacuum unit. The vacuum unit also includes an exhaust port which exhausts air in an exhaust path. The battery is disposed in the exhaust path to provide for cooling of the battery.

9 Claims, 12 Drawing Sheets

FIG - 2A
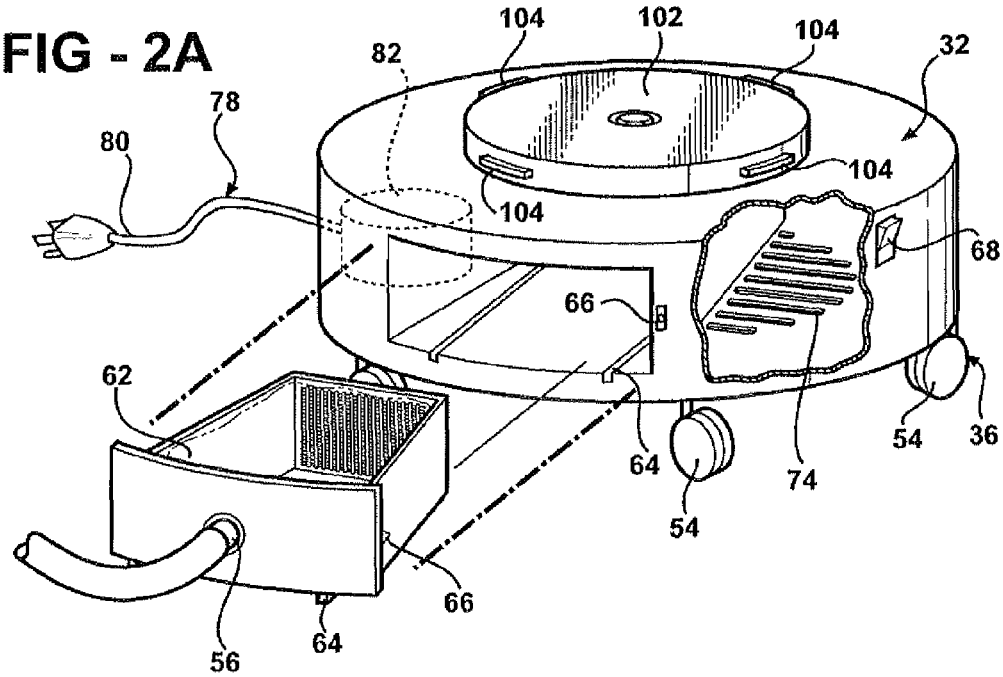
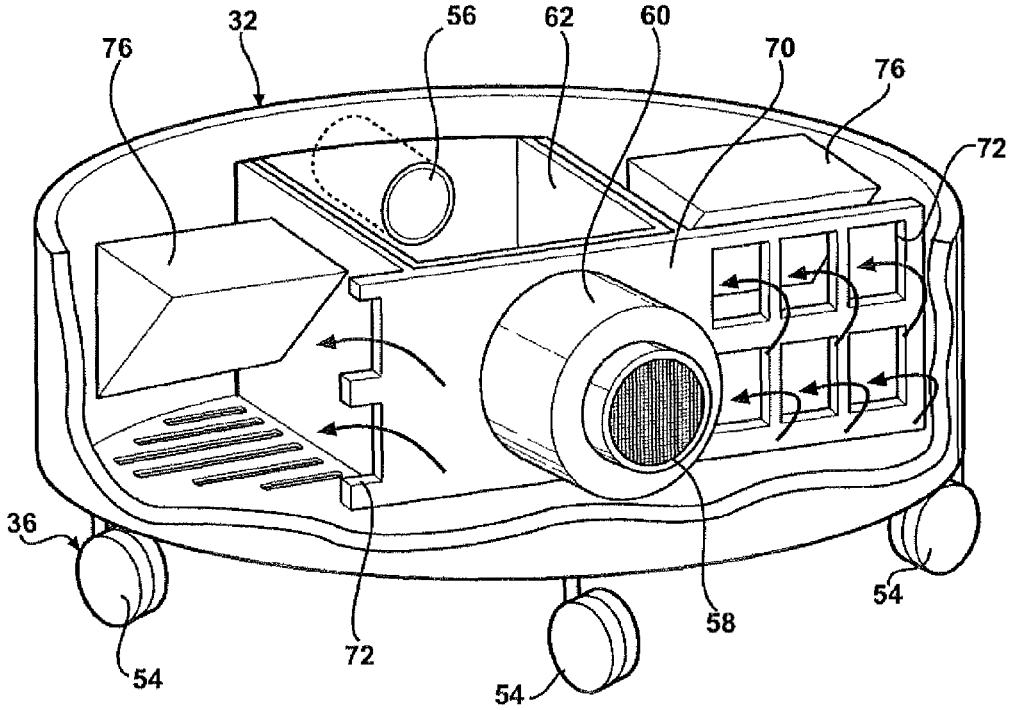
FIG - 2B

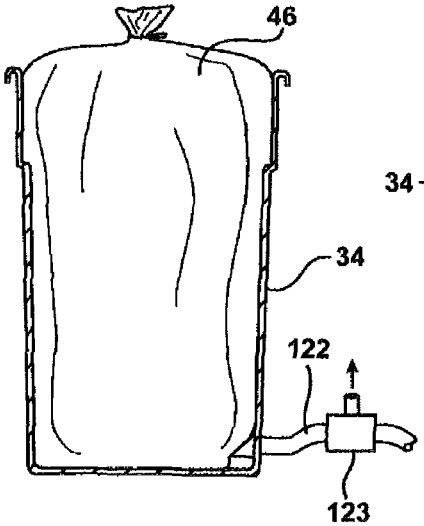
FIG - 19A
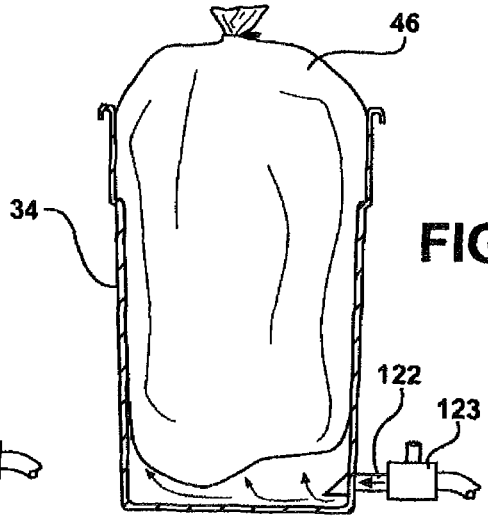
FIG - 19B
FIG - 19C
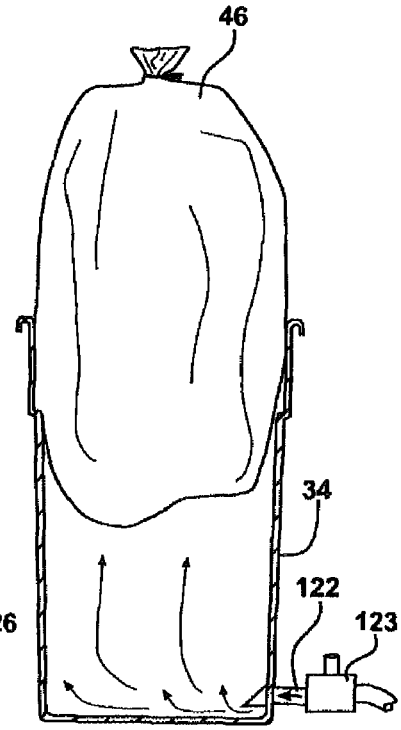
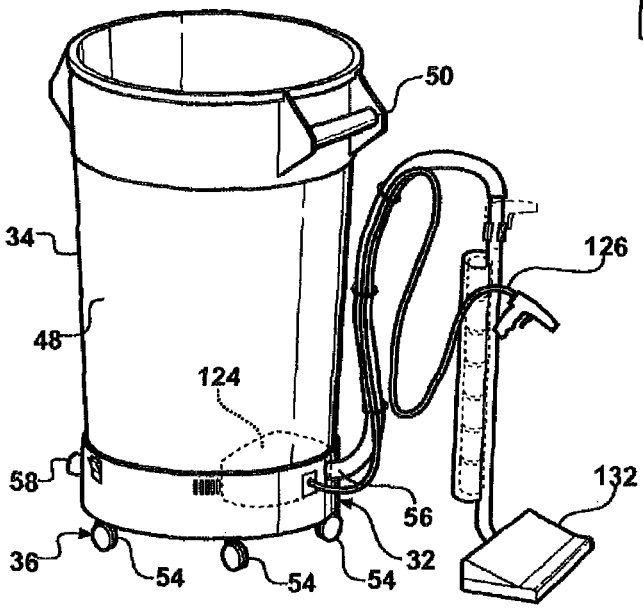
FIG - 20

PORTABLE CLEANING ASSEMBLY WITH WASTE CONTAINER

RELATED APPLICATIONS

This application is a continuation of U.S. patent application Ser. No. 11/738,120 filed on Apr. 20, 2007, which is a continuation of U.S. patent application Ser. No. 10/605,343 filed on Sep. 23, 2003, now U.S. Pat. No. 7,210,193, which is a continuation-in-part of U.S. patent application Ser. No. 10/116,768, filed on Apr. 4, 2002, now U.S. Pat. No. 6,732,403, and claims priority to U.S. Provisional Patent Applications having Ser. Nos. 60/427,288 filed on Nov. 18, 2002; 60/452,418 filed on Mar. 6, 2003; and 60/459,380 filed on Mar. 31, 2003.

BACKGROUND OF THE INVENTION

1. Field of the Invention

The subject invention relates to a portable cleaning assembly and specifically to a portable vacuum unit and waste container.

2. Description of the Related Art

The related art assemblies disclose a vacuum unit for applying a vacuum to clean an area such that the assembly is hidden and therefore not visible. One such assembly, shown in U.S. Pat. No. 5,205,013, includes a vacuum housed in a decorative storage and is designed to receive a plant to conceal the vacuum from view. The assembly is primarily for use in barbershops and hair salons. The vacuum has an inlet such that the vacuum does not have to be removed from the storage to be utilized. However, the vacuum is not portable and does not allow for collection of solid debris that cannot be vacuumed. Another assembly disclosed in U.S. Pat. No. 3,328,826 includes a vacuum unit housed in a hassock. The hassock conceals the vacuum from view, but does not include a container for receiving solid waste.

The related art assemblies also disclose a waste container attached to the vacuum unit for receiving waste. U.S. Pat. No. 6,058,560 discloses an assembly having a vacuum attached to a waste container. The vacuum has an inlet for attachment to a hose, which is preferably 20 feet length, to allow the vacuum to be utilized in an area without having to move the assembly. Further, the '560 patent suggests having multiple units disposed throughout the area so that the assemblies remain in the current location, without having to be moved. U.S. Pat. No. 6,199,714 discloses an assembly having a waste container housing a vacuum unit. The vacuum unit has an inlet in the bottom of waste container for cleaning up swept debris and for cleaning off dustpans. However, the waste container must be picked up and carried from one area to the next.

The related art assemblies are characterized by one or more inadequacies. Specifically, the assemblies do not provide a mechanism for making the waste container and vacuum unit portable to allow for efficient cleaning of large areas. The assemblies require additional passes through the area to perform specific cleaning functions, such as one pass for waste removal and another for vacuuming debris. These assemblies also require the user to carry the waste to the assembly or carry the assembly, which becomes increasingly heavy and burdensome.

SUMMARY OF THE INVENTION

The subject invention provides a cleaning assembly including a vacuum unit for applying a vacuum to clean debris from an area. The vacuum unit includes a motor for creating the vacuum along a vacuum path, a debris collection device in fluid communication with the motor for collecting the debris, and an exhaust port in fluid communication with the motor for exhausting air into an exhaust path. At least one battery is electrically connected to the motor for supplying electrical power to the motor. The battery is disposed at least partially within the exhaust path such that at least a portion of the air exhausted from the exhaust port cools the at least one battery. The assembly also includes a waste container associated with the vacuum unit and isolated from the vacuum path for collecting waste separate from the debris collected by the vacuum unit.

BRIEF DESCRIPTION OF THE DRAWINGS

Other advantages of the present invention will be readily appreciated as the same becomes better understood by reference to the following detailed description when considered in connection with the accompanying drawings wherein:

FIG. 2A is an exploded perspective side view of a transport mechanism and a vacuum unit for engaging a waste container;

FIG. 2B is a perspective side view of a backside of the transport mechanism and vacuum unit of FIG. 2A;

FIG. 19A is a cross-sectional side view of FIG. 18;

FIG. 19B is a cross-sectional side view of FIG. 18 having air blown into the waste container;

FIG. 19C is a cross-sectional side view of FIG. 18 having a waste liner being removed from the waste container with air assist; and FIG. 20 is a perspective view of yet still another embodiment of the portable cleaning assembly.

DETAILED DESCRIPTION OF THE INVENTION

Figure 1:
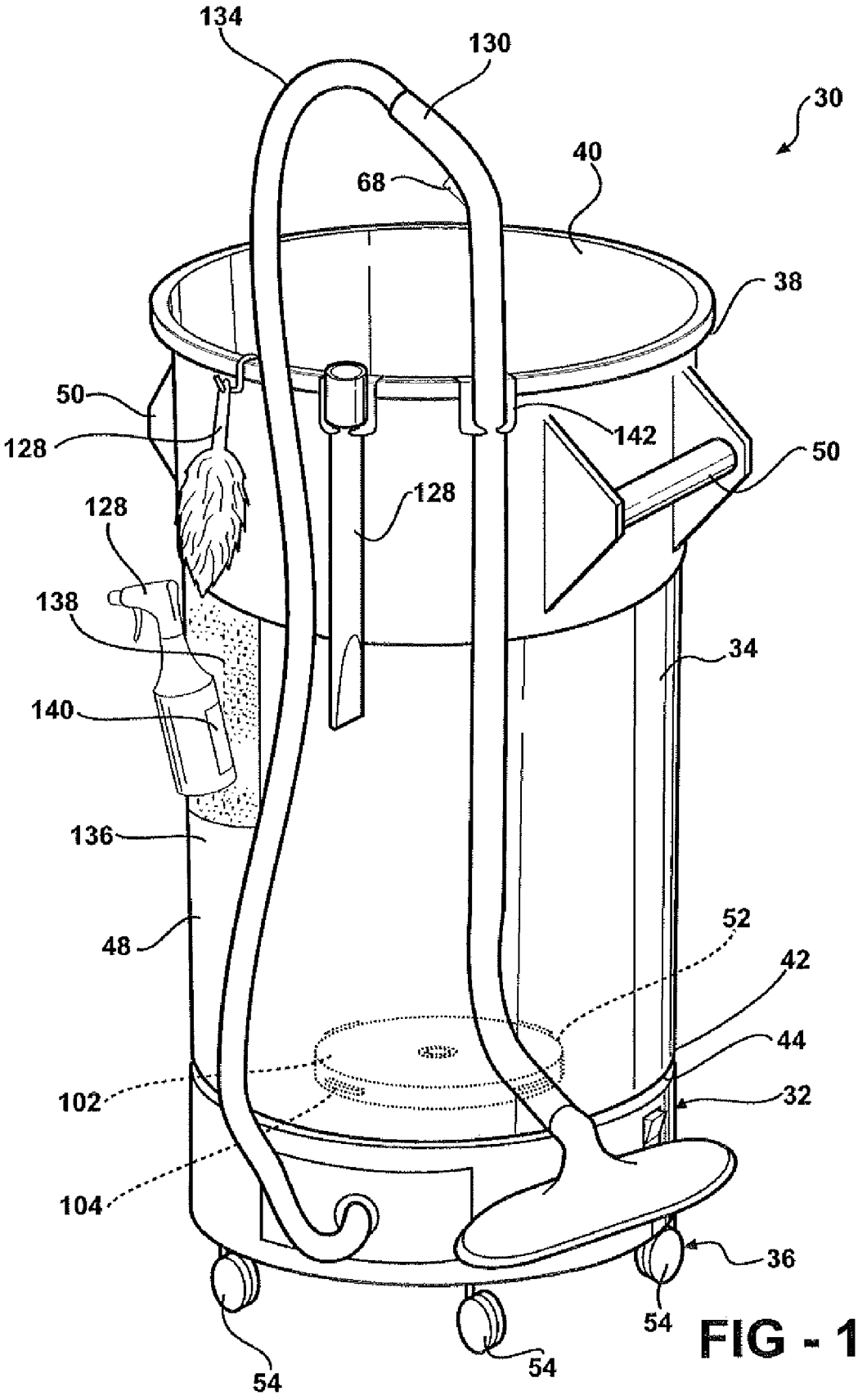
FIG. 1 is a perspective view of a portable cleaning assembly having a cleaning tool attached thereto.

Referring to the Figures, wherein like numerals indicate like or corresponding parts throughout the several views, a portable cleaning assembly is illustrated generally at 30 in FIG. 1. The assembly 30 includes a vacuum unit 32, a waste container 34, and a transport mechanism 36. The vacuum unit 32 applies a vacuum to clean an area to collect debris and the waste container 34 collects waste by a user separate from debris collected by the vacuum unit 32. The transport mechanism 36 supports the vacuum unit 32 and the waste container 34 thereof for moving the vacuum unit 32 and the waste container 34 across the area while applying the vacuum to collect the debris and while allowing independent filling of the waste container 34 with waste.

The waste container 34 for use with the subject invention is preferably, but not limited to, a circular fifty-five or a forty-four gallon barrel. However, differently shaped and sized containers may be utilized depending upon the particular applications. The waste container 34 has an upper end 38 with an opening 40 and a lower end 42 with a bottom 44. The opening 40 is designed to receive and secure a waste liner 46 to store any waste deposited therein. The waste container 34 includes a sidewall 48 extending between the upper end 38 and the lower end 42 with handles 50 extending therefrom. A waste container lid (not shown) may be disposed on the upper end 38 for enclosing the waste container 34. The bottom 44 of the waste container 34 has a recessed portion 52 for receiving either one of the vacuum unit 32 or the transport mechanism 36.

The transport mechanism 36 supports the vacuum unit 32 and the waste container 34 thereof for moving the vacuum unit 32 and the waste container 34 across the area while applying the vacuum to collect the debris and while allowing for independent filling of the waste container 34 with waste. The transport mechanism 36 may include wheels 54 for moving about the area, and more preferably includes at least three castors. Of course, it is to be understood that different types of wheels 54 may be utilized depending upon the type of vacuum unit 32 and waste container 34.

Figure 3A:
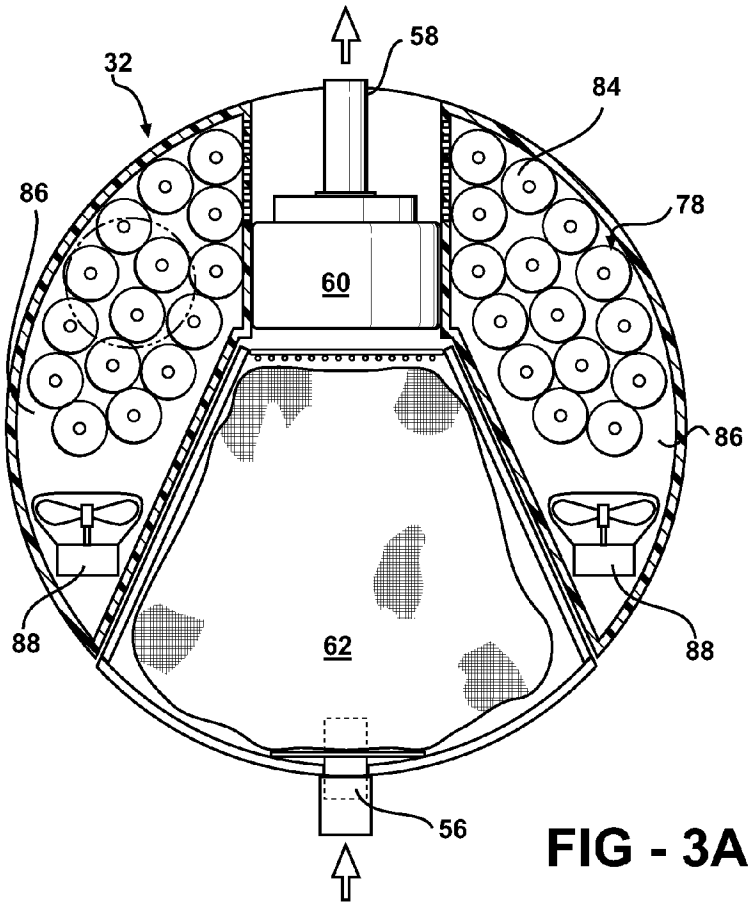
FIG. 3A is a top view of an alternate embodiment of the transport mechanism and the vacuum unit showing batteries and separate battery fans for cooling the batteries.
Figure 3C:
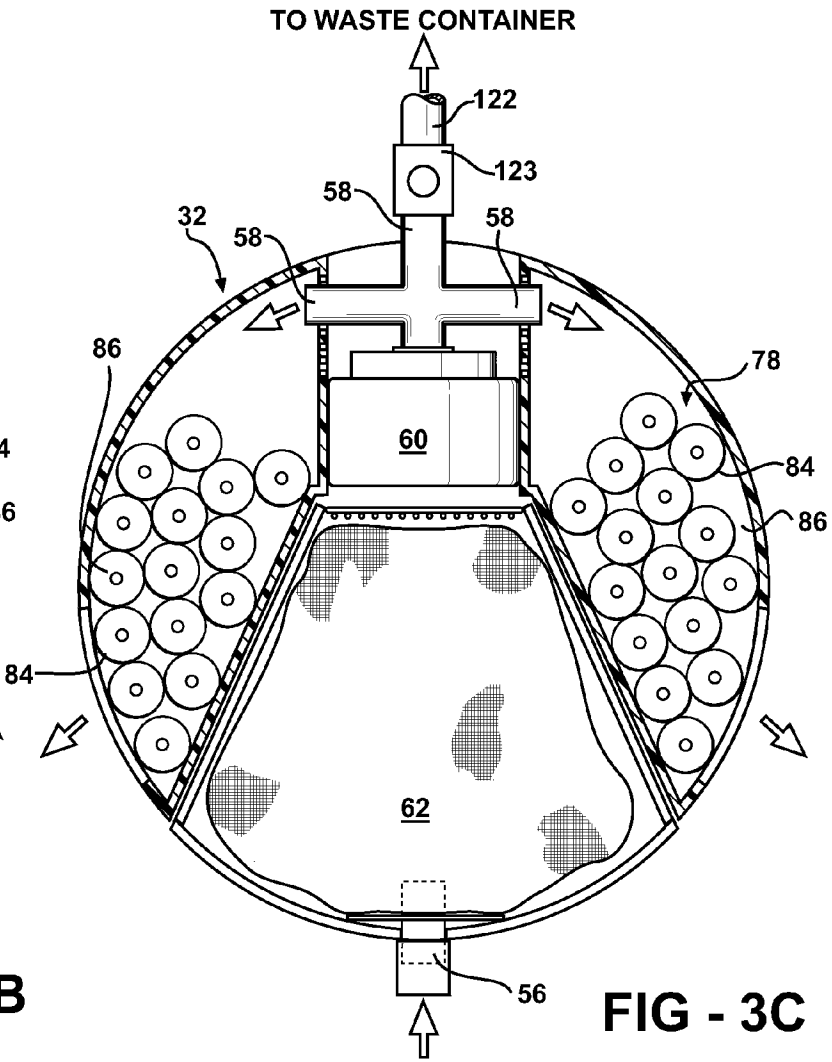
FIG. 3C is a top view of an alternate embodiment of the transport mechanism and the vacuum unit showing batteries within the exhaust path of the vacuum unit and a diverter for diverting exhaust air from the vacuum unit.
Figure 3B:
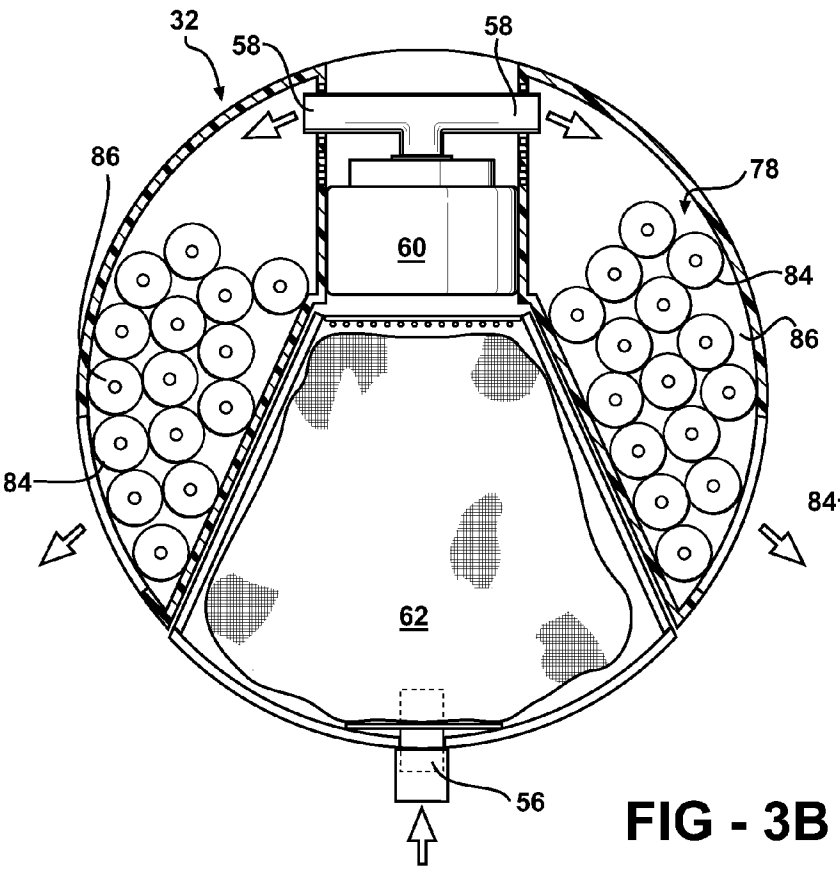
FIG. 3B is a top view of an alternate embodiment of the transport mechanism and the vacuum unit showing batteries within the exhaust path of the vacuum unit.
Figure 6:
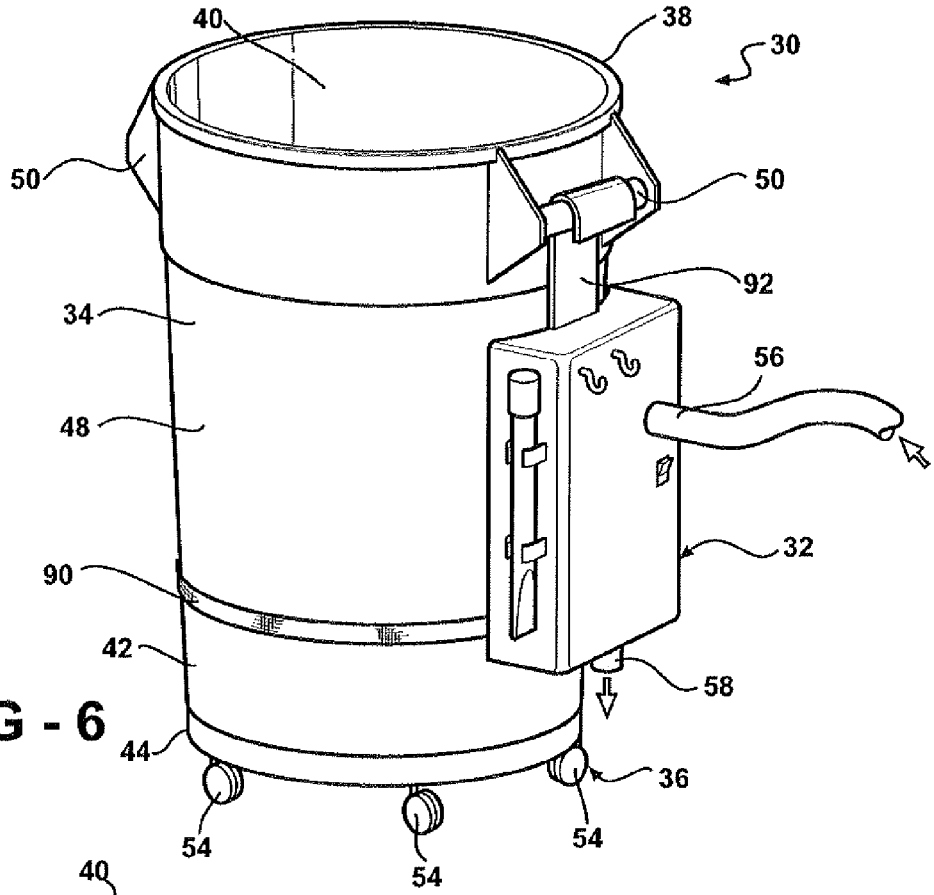
FIG. 6 is a perspective side view of the portable cleaning assembly with the vacuum unit having a hook engaging the waste container.
Figure 7:
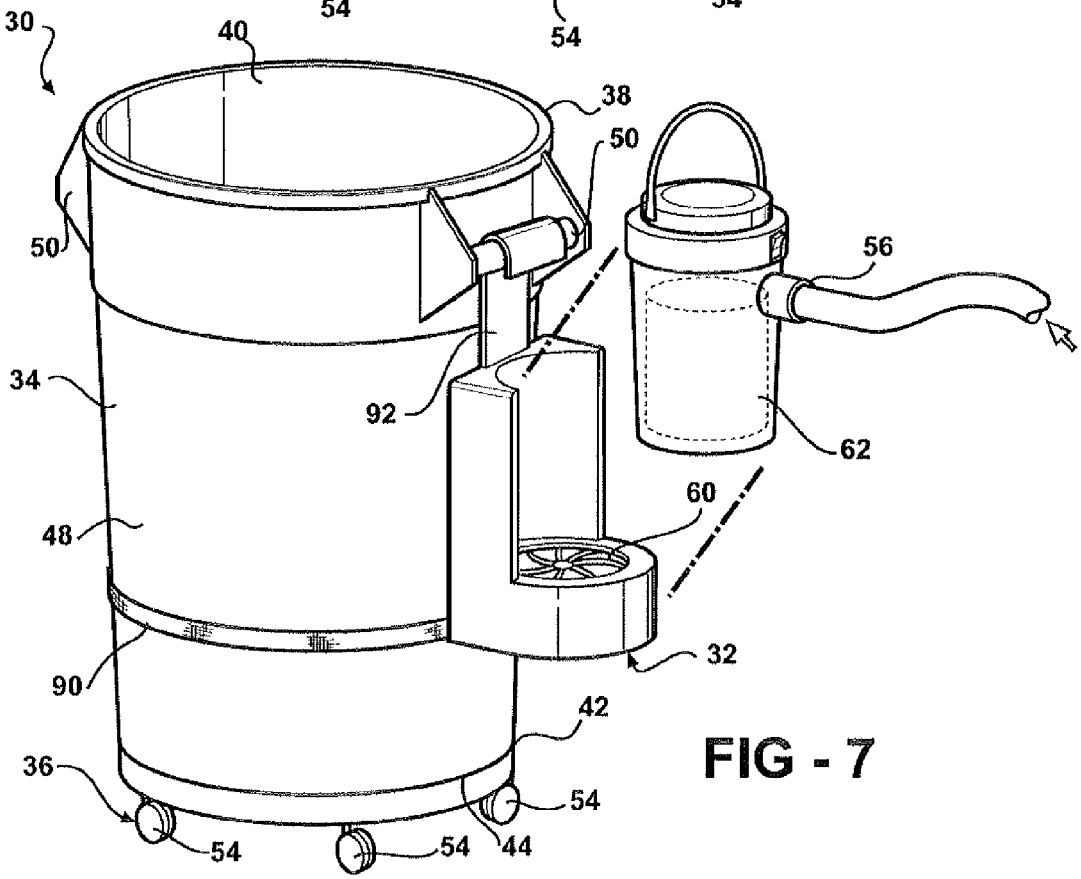
FIG. 7 is a perspective side view of the portable cleaning assembly with an alternate embodiment of the vacuum unit.
Figure 8A:
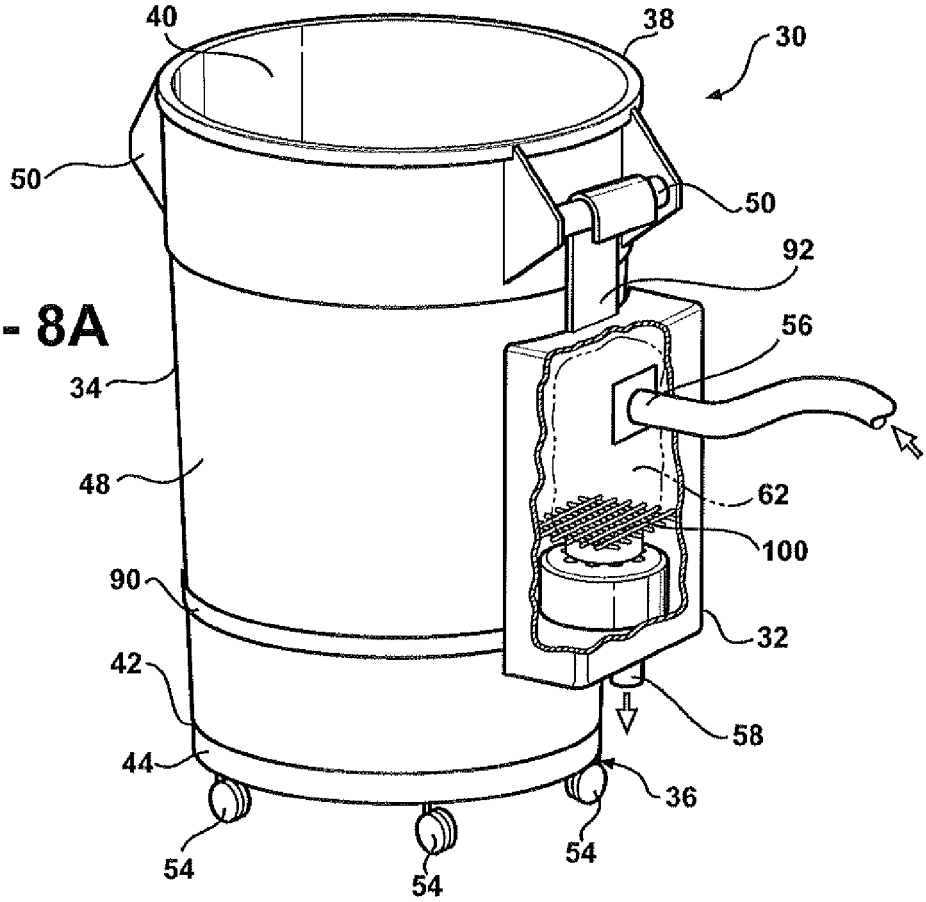
FIG. 8A is a perspective side view of another embodiment of the vacuum unit supported by the hook on the waste container.
Figure 8B:
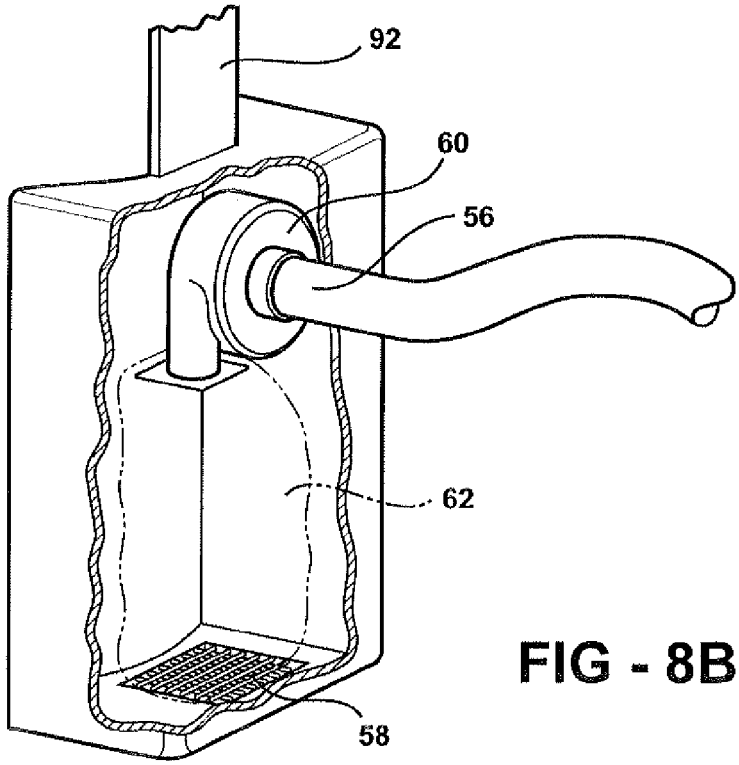
FIG. 8B is a perspective side view of still another embodiment of the vacuum unit.

Vacuum units 32 are known to those skilled in the art and various configurations may be employed with the subject invention. By way of example, and not limiting, the vacuum unit 32 includes an intake port 56 and an exhaust port 58 as illustrated in FIGS. 2-8B. A motor 60 connected to a fan for inducing a pressure drop and creating the vacuum and a debris collection device 62 are disposed between the intake port 56 and the exhaust port 58 for collecting the debris as best shown in FIG. 3.

The debris collection device 62 may be a vacuum bag, a canister, a dirt cup, or a pull drawer disposed between the intake port 56 and the exhaust port 58. In FIGS. 2A and 2B, the debris collection device 62 is illustrated as the pull drawer. The pull drawer has alignment ribs 64 for aligning with the fan and motor 60. The alignment ribs 64 ensure that the debris collection device 62 is aligned properly which ensures optimal operation of the vacuum unit 32. The ribs 64 may be formed within the vacuum unit 32 for receiving the debris collection device 62. With the ribs 64 in the vacuum unit 32, the assembly 30 may be formed from a single mold without having to switch for those debris collection devices that are bags and those that are drawer. The ribs 64 allow for the bag to inflate and also align the drawer. Living clips 66 may be used to secure the drawer in the vacuum unit 32.

A switch 68 may be used to operate the vacuum unit 32. The switch 68 is shown on the vacuum unit 32, but it may be located elsewhere for easy access. Referring to FIG. 2B, the transport mechanism 36 and the vacuum unit 32 are viewed from the rear. The vacuum unit 32 includes a divider 70 extending across the vacuum unit 32 and having apertures 72 therein for venting exhaust from the motor 60 and fan. The exhaust flows through the apertures 72 in the divider 70 and are directed out an exhaust 74 by a baffle 76. FIG. 3 illustrates the debris collection device 62 as the porous bag. The debris collection device 62 may be supported either outside of the vacuum unit 32 for allowing easy removal and replacement or inside of the vacuum unit 32 for concealment.

Once the motor 60 is activated, the fan rotates and the vacuum pulls debris-filled air into the intake port 56. The debris-filled air passes through the vacuum bag, made of porous woven material, which acts as an air filter. The porous woven material has tiny holes large enough to let air particles pass by, but too small for most debris particles to fit through. Thus, when the air streams into the bag, all the air moves on through the porous woven material, but the debris collects in the vacuum bag. The vacuum bag may be positioned anywhere along the path between the intake port 56 and the exhaust port 58, as long as the air flows through it, such as upstream or downstream from the motor 60 and fan. In FIGS. 2A, 2B, 3, 6, 7, and 8A, the debris collection device 62 is illustrated upstream from the motor 60 and fan, while in FIG. 8B, the debris collection device 62 is illustrated downstream from the motor 60.

Alternatively, the vacuum unit 32 may be a cyclone-type vacuum that sends the debris-filled air through one or more cylinders, along a high-speed spiral path. As the debris-filled air shoots around in a spiral, all of the debris experiences a powerful centrifugal force and is extracted from the air without using any sort of filter and is collected at the bottom of the debris collection device 62.

The vacuum unit 32 further includes a power source 78 for operating the motor 60. The power source 78 may be a cord 80 connected to the motor 60 for connection to an electrical circuit, as shown in FIG. 2. A cord reel 82 may be disposed within any one of the vacuum unit 32, the waste container 34, or the transport mechanism 36 for receiving the cord 80. A clip may be used to secure the cord 80 thereto. One type of clip that may be particularly useful is commonly referred to as a Schulte clip (not shown) for connecting power to the vacuum unit 32, as understood by those skilled in the art.

Figure 15:
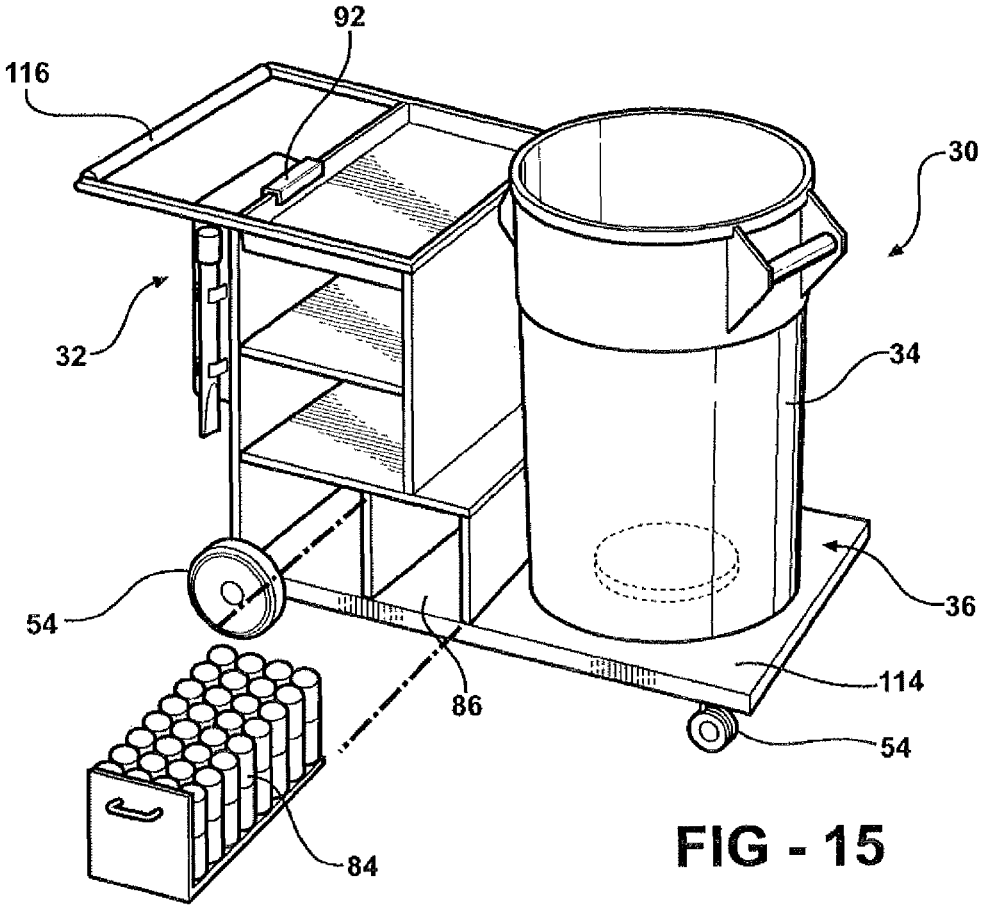
FIG. 15 is a perspective side view of yet another embodiment of the portable cleaning assembly.

Alternatively, the power source 78 may be a battery 84 supported by one of the vacuum unit 32, the waste container 34, or the transport mechanism 36 as shown in FIGS. 3 and 15. When the battery 84 is utilized, the vacuum unit 32 may be operated anywhere between 2½ and 7 hours depending upon the type of battery 84 utilized. It is to be understood that longer operating times may be obtained by using different or additional batteries. When utilizing the batteries, the assembly 30 may include a battery storage 86 for storing the batteries during operation and or during recharging. The battery storage 86 may be located in any one of the vacuum unit 32, the waste container 34, or the transport mechanism 36.

In FIG. 3, the battery storage 86 is shown in the vacuum unit 32. Additionally, the battery storage 86 may be located in various vacuum tools (as shown in FIG. 20). One type of battery 84 that may be used is a rechargeable battery. During the use and recharging of the batteries 84, the batteries 84 may have a tendency to generate heat. Therefore, a battery fan 88 may be used to create air flow about the batteries 84 for cooling the batteries 84. The battery fan 88 may be integral with the fan for creating the vacuum or it may be separate. It is to be further appreciated that multiple motors may be used with the subject invention. For example, two motors may be use, one motor that is battery operated and another motor that is not battery operated for use when the batteries are low.

Figure 4:
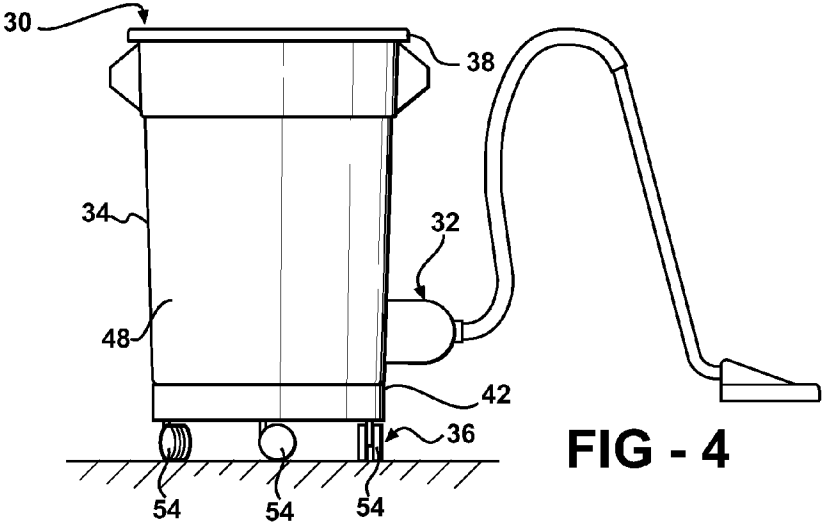
FIG. 4 is a side view of the portable cleaning assembly according to the subject invention having the vacuum unit supported by the waste container.
Figure 5:
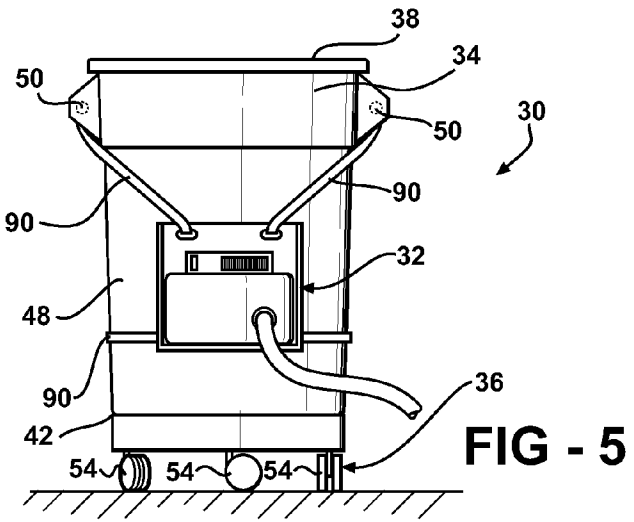
FIG. 5 is a side view of the portable cleaning assembly according to the subject invention having the vacuum unit removeably supported by the waste container.

Referring to FIGS. 4-8B, the vacuum unit 32 is illustrated as being supported by the sidewall 48 of the waste container 34. In FIG. 4, the vacuum unit 32 is illustrated as permanently fixed to the exterior of the waste container 34. FIG. 5 illustrates the vacuum unit 32 being removably mounted to the sidewall 48 allowing the vacuum unit 32 to be taken off and replaced with a new vacuum unit 32 or a refurbished vacuum unit 32. Straps 90 wrap around the waste container 34 and the handles 50 to secure the vacuum unit 32 in place. In FIG. 6-8B, the vacuum unit 32 has a hook 92 supported by the handle 50 of the waste container 34 and also includes straps 90 extending around the waste container 34 to prevent the vacuum unit 32 from moving side to side.

Figure 11:
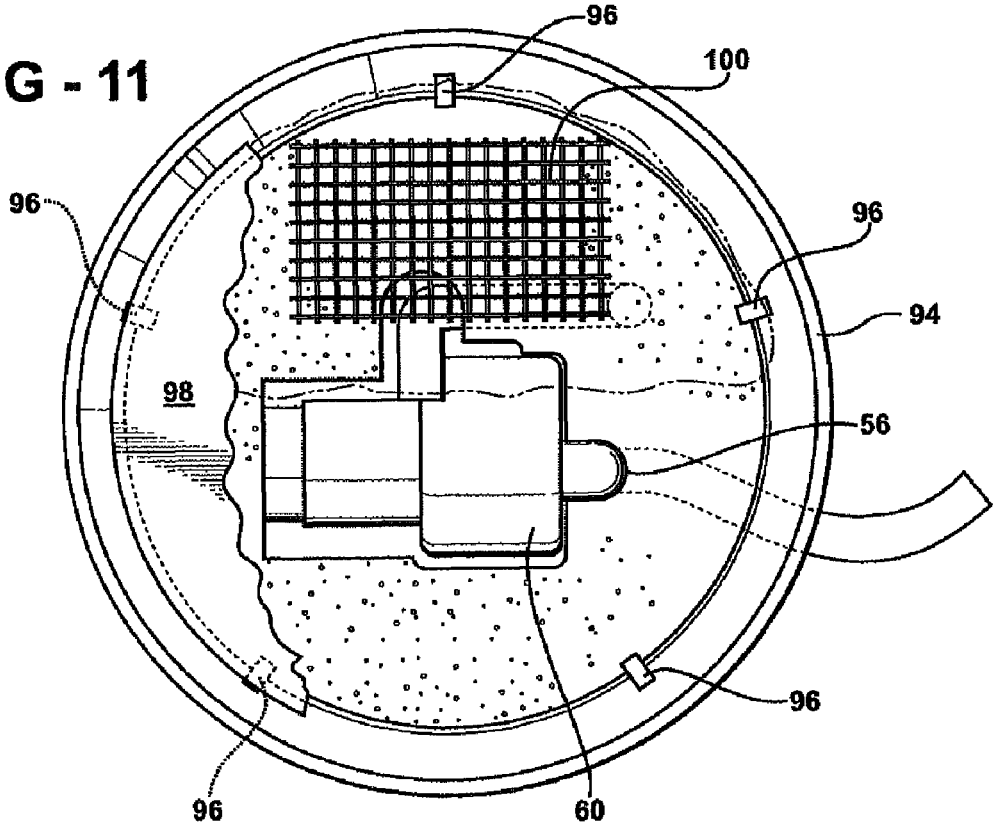
FIG. 11 is a top-down view of the vacuum unit having sidewalls for supporting a lid to enclose the vacuum unit.

Referring to FIG. 11, a top view of one embodiment of the vacuum unit 32 is shown. The vacuum unit 32 is illustrated housed within a sidewall 94 which receives the waste container 34. The vacuum unit 32 includes supports 96 located within the interior of the sidewall 94 for supporting either a lid 98 to enclose the vacuum unit 32 or the supports 96 may support the waste container 34 directly. The support 96 may be an integrally formed lip or may be individual supports 96. In this embodiment, the vacuum unit 32 may be mounted directly into the bottom 44 of the waste container 34. As shown in FIG. 11, there are five supports 96 mounted to the sidewall 94 to support the lid 98 and a grid 100 is positioned in the vacuum unit 32. The grid 100 allows the bag to expand when the vacuum unit 32 is operated. It is to be appreciated that various grids may be employed to allow the bag to properly inflate as understood by those skilled in the art. The grid 100 may be integrally formed in the base of the vacuum unit 32 as wire mesh. The grid 100 may also be located on the underside of the lid 98. Alternatively, the lid 98 may be act as a permanent floor such that access to the vacuum unit 32 is through the bottom. The vacuum unit may be releaseable for servicing.

Figure 12:
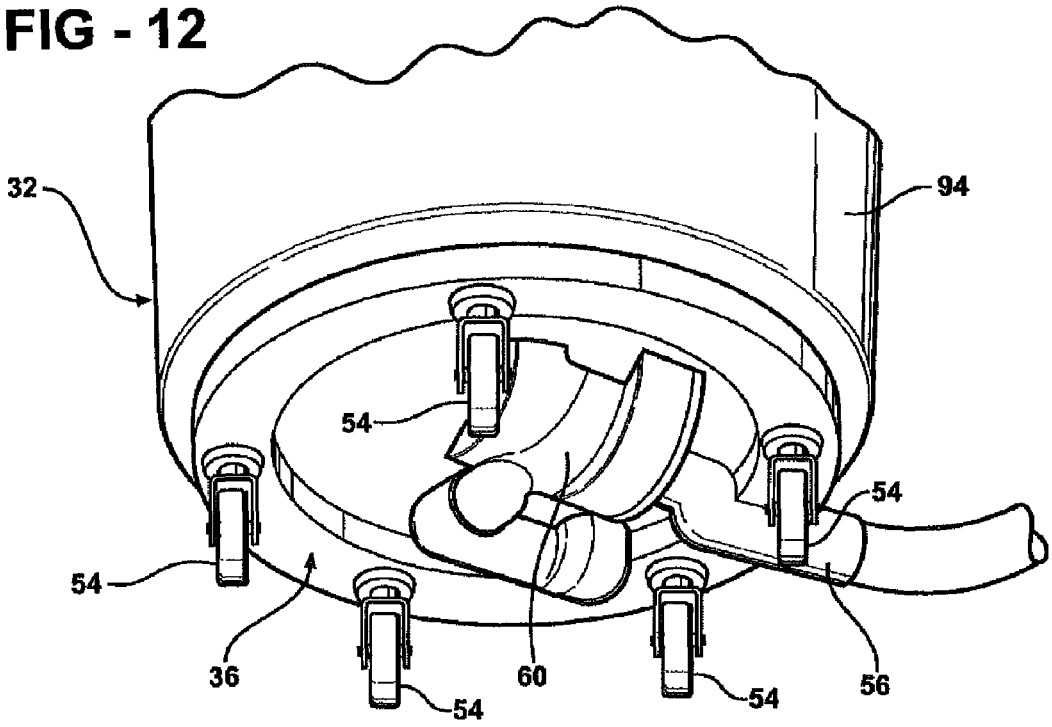
FIG. 12 is a bottom view of another embodiment of the transport mechanism and the vacuum unit.
Figure 13:
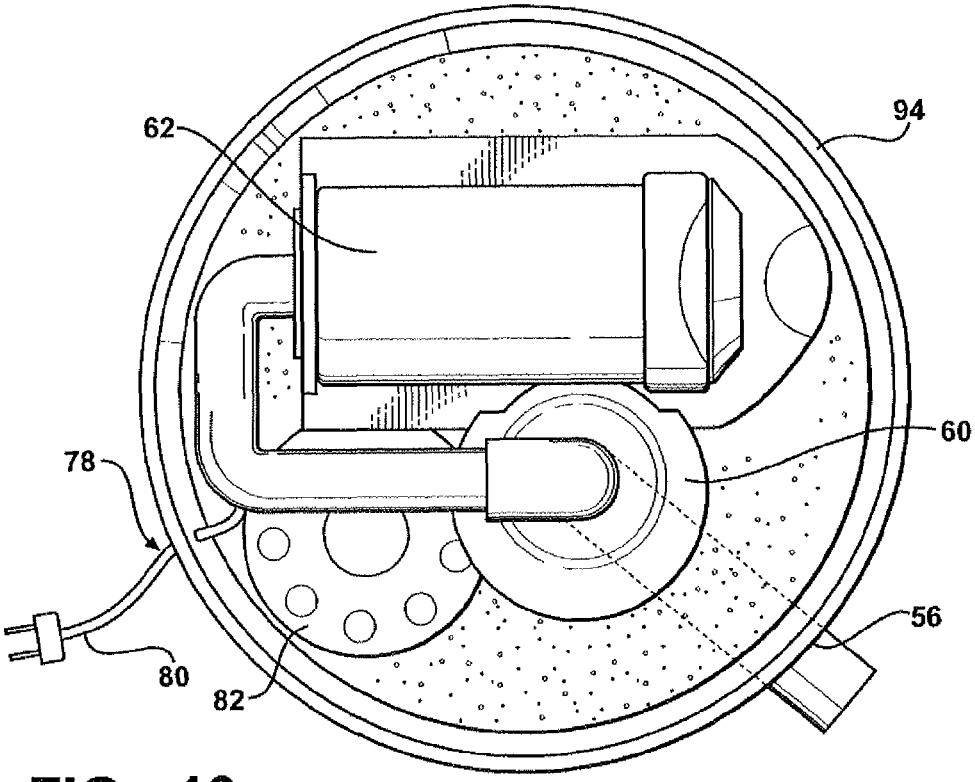
FIG. 13 is a top-down view of still another embodiment of the vacuum unit.

Referring to FIG. 12, a bottom view of another embodiment of the vacuum unit 32 is shown having a portion of the motor 60 extending through the transport mechanism 36. The motor 60 has the intake port 56 extending through the base for allowing fast and efficient connection of the vacuum attachments. In FIG. 13, the vacuum unit 32 is shown including the canister as the debris collection device 62. The cord reel 82 is positioned adjacent the motor 60 for storing the cord 80. However, it is to be appreciated that the inlet may extend through the sidewalls 94 of the vacuum unit 32 and the motor 60 may be contained entirely within the vacuum unit 32.

Figure 9:
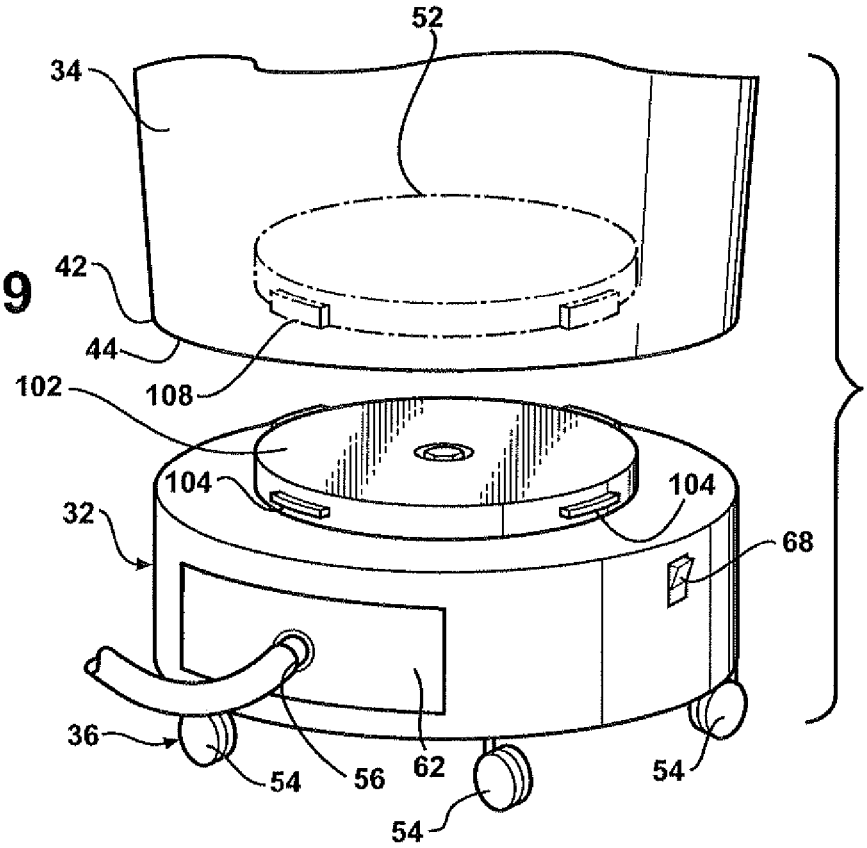
FIG. 9 is a perspective side view of the transport mechanism and the vacuum unit having a raised portion with projections for engaging the waste container.
Figure 10:
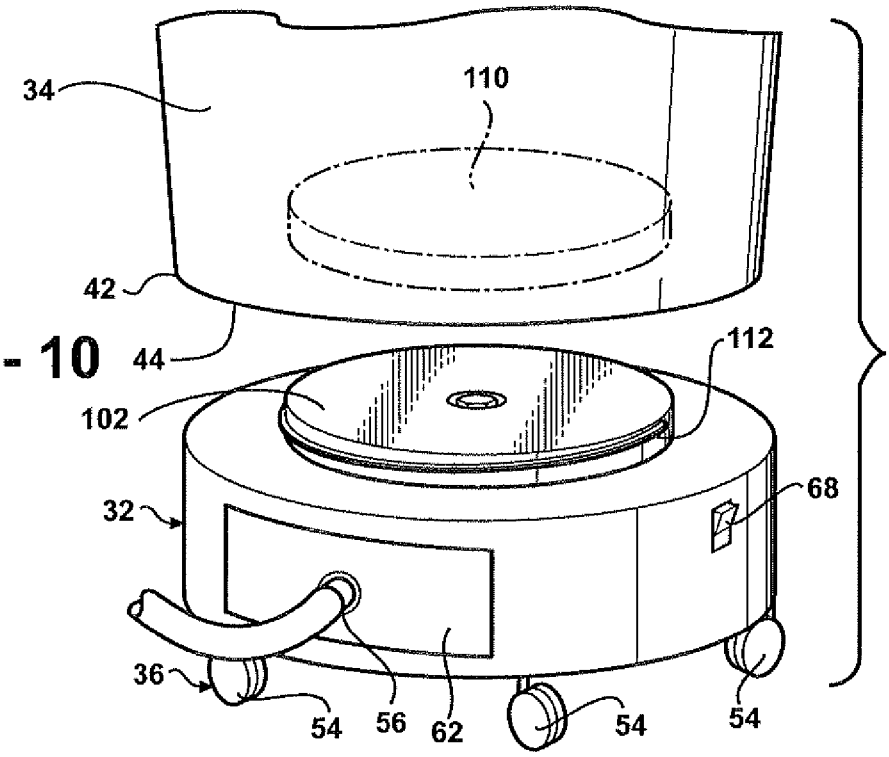
FIG. 10 is a perspective side view of the transport mechanism and the vacuum unit having a male threaded element for engaging the waste container.

The transport mechanism 36 may be removable from one of the waste container 34 and the vacuum unit 32. Referring back to FIG. 2A, the vacuum unit 32 includes a raised portion 102 with projections 104. Referring to FIGS. 9 and 10, the transport mechanism 36 and vacuum unit 32 are integral and may be able to be locked or screwed to the waste container 34. In FIG. 9, the transport mechanism 36 and vacuum unit 32 includes the raised portion 102 with projections 104 and the waste container 34 includes the recessed portion 52 with slots 108 for receiving the projections 104 for securing the transport mechanism 36 thereto. As shown in FIG. 10, the recessed portion 52 of the waste container 34 is a female threaded element 110 and the vacuum unit 32 has a male threaded element 112. The female threaded element 110 is threadably mated with the male threaded element 112 to secure the waste container 34 to the vacuum unit 32. It is to be appreciated that the male and female elements may be reversed while still practicing the subject invention. When the waste container 34 becomes full, the waste container 34 may be removed from the vacuum unit 32 and emptied. The empty waste container 34 is then replaced back on top of the vacuum unit 32.

Figure 14:
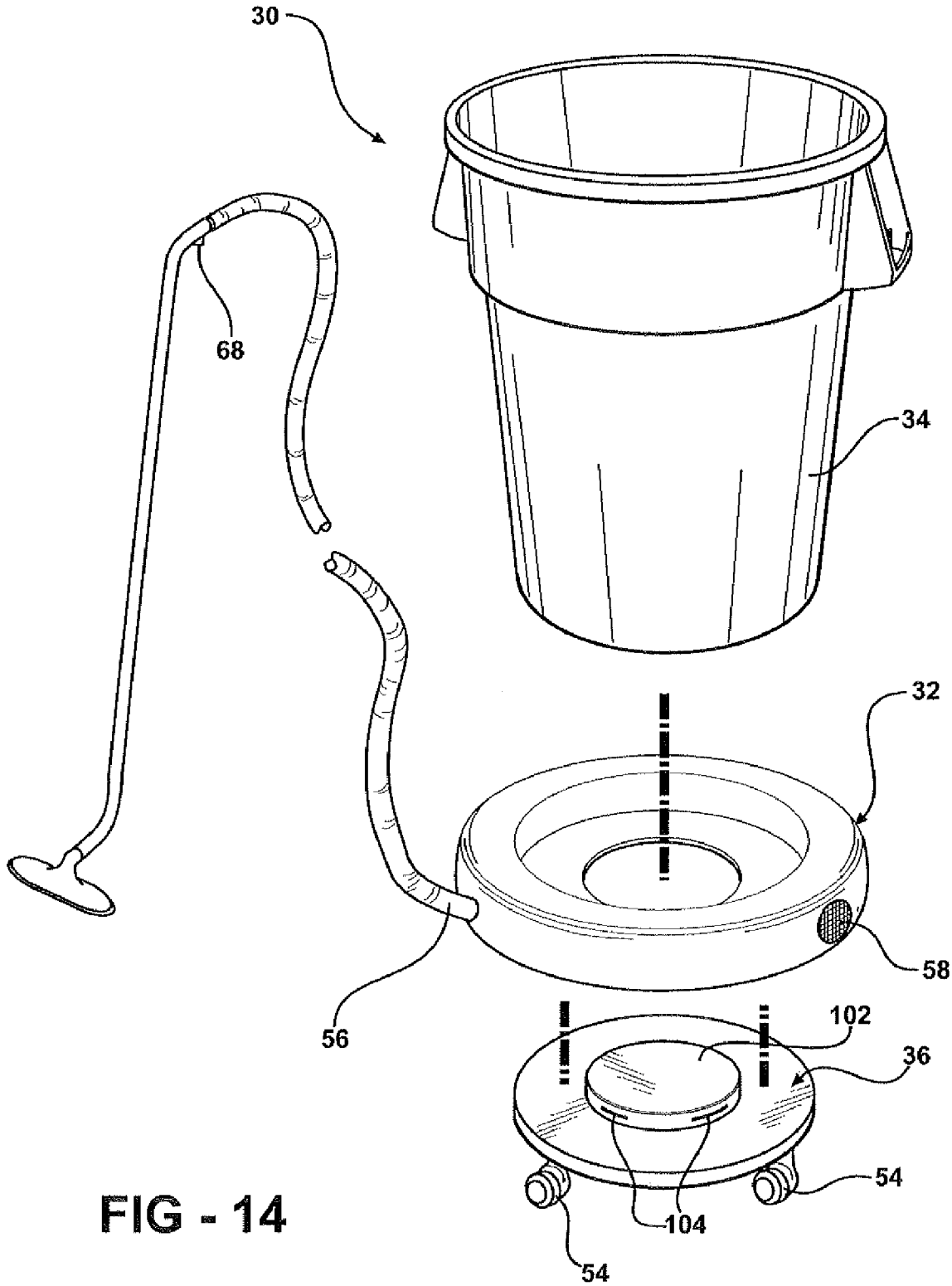
FIG. 14 is an exploded perspective view of another embodiment of the portable cleaning assembly.

Yet another embodiment of the portable cleaning assembly 30 is illustrated in FIG. 14. The vacuum unit 32 is ring shaped to be positioned on the transport mechanism 36. The transport mechanism 36 has the raised portion 102 for engaging the waste container 34 and for securing the waste container 34 to the vacuum unit 32. The raised portion 102 may either include the projections 104 or be threaded to secure the waste container 34 thereto.

Figure 16:
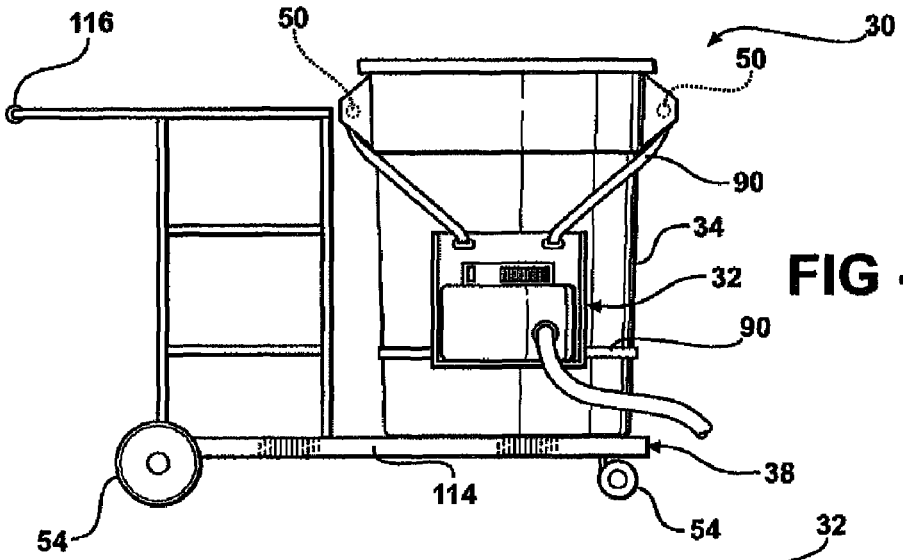
FIG. 16 is a perspective side view of the portable cleaning assembly of FIG. 15 having the vacuum unit supported by the waste container.
Figure 17:
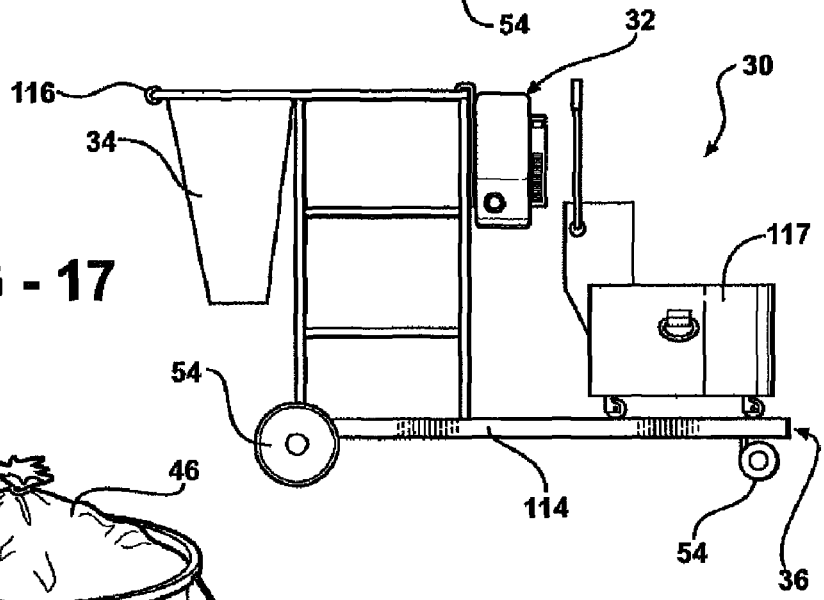
FIG. 17 is a perspective side view of the portable cleaning assembly of FIG. 15 having the vacuum unit supported by the transport mechanism.

Referring to FIGS. 15-17, the transport mechanism 36 is illustrated as including a bed 114 being generally horizontal for supporting the vacuum unit 32 and the waste container 34 next to one another. It is to be appreciated that either the vacuum unit 32 or the waste container 34 may be above or beneath one another as set forth in the other embodiments described above. The transport mechanism 36 is illustrated as a push cart having a handle 116 extending upwardly from the bed 114 for moving about the area when the vacuum unit 32 and the waste container 34 are positioned on the bed 114. Either one of the waste container 34 and the vacuum unit 32 may be supported by the handle 116 of the bed 114 as well. Referring specifically to FIG. 15, the vacuum unit 32 has the hook 92 and is mounted to the transport mechanism 36 and the waste container 34 is supported on the bed 114. The transport mechanism 36 includes the battery storage 86 for the vacuum unit 32. In FIG. 16, the vacuum unit 32 is supported by the waste container 34, which is supported on the bed 114 of the transport mechanism 36. Referring to FIG. 17, the waste container 34 is supported by the handle 116 and the vacuum unit 32 is supported by the transport mechanism 36. The transport mechanism 36 can support other cleaning equipment such as a bucket 117.

Figure 18:
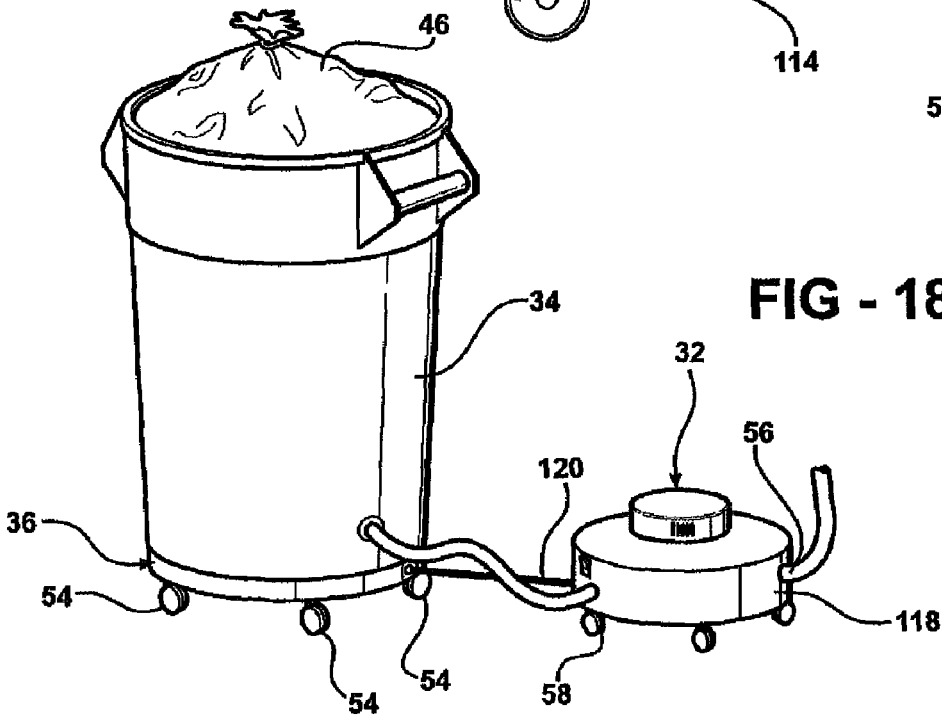
FIG. 18 is a perspective side view of the portable cleaning assembly including the transport mechanism supporting the waste container and a sub-transport mechanism supporting the vacuum unit.

The transport mechanism 36 may include a sub-transport mechanism 118 as shown in FIG. 18. The transport mechanism 36 supports one of the vacuum unit 32 and the waste container 34 and the sub-transport mechanism 118 supports the other. A linkage 120 is positioned between the transport mechanism 36 and the sub-transport mechanism 118 to move the transport mechanism 36 and the sub-transport mechanism 118 at the same time.

Referring to FIGS. 19A-19C, the exhaust port 58 of the vacuum unit 32 is also capable of acting as a blower, which is typically employed for utility vacuums. The assembly 30 may include a release hose 122 extending within the waste container 34 and connected to the exhaust port 58 for releasing the waste liner 46 within the waste container 34. A diverter 123 may be used to direct the air into the release hose 122 and into the waste container 34 as would be appreciated by those skilled in the art. This is particularly useful when using the waste liner 46 and it begins to fill and expand within the waste container 34. A suction-pressure holds the liner into the waste container 34 making it difficult to remove, as shown in FIG. 19A. When the air is diverted into the release hose 122 as in FIG. 19B, the air overcomes the suction-pressure making it easier to remove the liner from the waste container 34, as in FIG. 19C. It is to be appreciated that the release hose 122 may be adapted for any of the vacuum unit embodiments and any of the portable cleaning assembly embodiments.

Referring to FIG. 20, the assembly 30 may also include a bladder 124 for storing a cleaning solution. The bladder 124 may be housed within the vacuum unit 32 or the waste container 34. A spray nozzle 126 extends from the bladder 124 for spraying the cleaning solution. The bladder 124 may be pressure operated or operated by a hand pump such as the nozzle as would be appreciated by those skilled in the art. The bladder 124 may also be housed outside of the vacuum unit 32 or waste container 34 for easy access and refilling.

Referring back to FIG. 1, a plurality of vacuum attachment tools 128 are shown mounted to the exterior of the vacuum unit 32 and waste container 34. The attachment tools 128 connect to the vacuum unit 32 via a vacuum handle 130. The handle 130 may include the switch 68 for powering on and off the vacuum unit 32. One of the vacuum attachment tools 128 includes a power brush 132 (shown in FIG. 20) and a hose 134 connected to the inlet for collecting debris. The power brush 132 is operable by the on/off, commonly referred to as a dead mans or momentary, switch 68 for turning the power brush 132 on and off. This allows for power conservation because the user can quickly and effortlessly turn off the vacuum by letting go of a finger, without having to bend over to reach the switch 68. In operation, the user actuates the dead mans switch 68 which turns the vacuum on. Once the user releases the switch 68, the vacuum turns off. Preferably, the power brush 132 has a wand that the user holds onto and that is where the dead mans switch 68 is located. When the vacuum unit 32 is battery operated, the dead mans switch 68 increases the time of usage between recharging. The hose 134 may be flexible, collapsible, or the like, depending upon the particular applications. In addition to vacuum attachments, other accessories and cleaning supplies, may be attached, such as key holders, spray bottles, squeegees, feather duster and the like.

The waste container 34 has an exterior surface 136 for securing the vacuum attachments thereto. The exterior surface 136 may have a hook fastener 138 disposed on the exterior surface 136 and the vacuum attachments may have a loop fastener 140 for securing the vacuum attachments thereto. Alternately, the loop fastener 140 may be on the exterior surface 136 and the hook fastener 138 on the attachments. The hook fastener 138 has stiff little hooks on it, while the loop fastener 140 is soft and fuzzy, which is commercially available as Velcro®. The Velcro® may be covering the entire exterior surface 136 or as small patches for attaching the attachments thereto. Preferably, the hook fastener 138 on the exterior surface 136 of the vacuum unit 32 and the waste container 34 is marine carpet. The marine carpet has advantages over other fasteners, because it can get wet and will not mildew. The subject invention may also include a hose rest 142, shown generally U-shaped, releasably connected to the exterior surface 136 for supporting the vacuum attachments and specifically, the hose 134.

Obviously, many modifications and variations of the present invention are possible in light of the above teachings. It is, therefore, to be understood that within the scope of the appended claims, the invention may be practiced otherwise than as specifically described.

What is claimed is:

1. A cleaning assembly comprising;

a vacuum unit for applying a vacuum to clean debris from an area including a motor for creating the vacuum along a vacuum path, a debris collection device in fluid communication with said motor for collecting the debris, and an exhaust port in fluid communication with said motor for exhausting air into an exhaust path;

at least one battery electrically connected to said motor for supplying electrical power to said motor and disposed at least partially within said exhaust path such that at least a portion of the air exhausted from said exhaust port cools said at least one battery; and a waste container associated with said vacuum unit and isolated from said vacuum path for collecting waste separate from the debris collected by said vacuum unit.

2. An assembly as set forth in claim 1 further comprising a transport mechanism supporting said vacuum unit and said waste container thereof for moving said vacuum unit and said waste container while applying the vacuum to collect the debris and while allowing independent filling of said waste container with waste.

3. An assembly as set forth in claim 1 further including a battery storage for storing said at least one battery.

4. An assembly as set forth in claim 3 wherein said battery storage is further defined as within said vacuum unit.

5. An assembly as set forth in claim 1 wherein said exhaust path extends to said waste container for releasing a waste liner from said waste container with the air exhausted from said exhaust port.

6. An assembly as set forth in claim 5 further comprising a release hose extending within said waste container and connected to said exhaust port for providing at least a portion of said exhaust path and fluid communication between said waste container and said exhaust port.

7. An assembly as set forth in claim 6 further comprising a diverter disposed between said exhaust port and said waste container for controlling the flow of air into said waste container.

8. A cleaning assembly as set forth in claim 1 wherein said waste container is supported by said vacuum unit.

9. A cleaning assembly as set forth in claim 1 wherein said vacuum unit is supported by said waste container.

* * * * *